United States Patent [19]

Lundin

[11] 3,931,069

[45] Jan. 6, 1976

[54] DISPERSION FOR SIZING CELLULOSE FIBRES AND USE THEREOF

[75] Inventor: Claes Olof Axel Lundin, Boras, Sweden

[73] Assignee: KemaNord AB, Stockholm, Sweden

[22] Filed: July 10, 1973

[21] Appl. No.: 377,972

[30] Foreign Application Priority Data

July 14, 1972 Sweden ..... 9282/72

[52] U.S. Cl. ..... 260/17 R; 106/170; 106/187; 106/197 R; 162/158; 162/164; 162/168; 162/175; 162/177; 260/13; 428/396

[51] Int. Cl.[2] .. C08L 1/28; D21H 3/26; D21H 3/38; D21D 3/00

[58] Field of Search ..... 162/158, 177; 117/157; 106/170, 187, 197 R; 260/17 R, 13; 428/396

[56] References Cited

UNITED STATES PATENTS

| | | | |
|---|---|---|---|
| 2,627,477 | 2/1953 | Downey | 117/157 |
| 2,762,270 | 9/1956 | Keim et al. | 117/157 |
| 3,006,806 | 10/1961 | Schur | 162/158 |
| 3,212,961 | 10/1965 | Weisgerber | 162/158 |
| 3,311,532 | 3/1967 | Kulick et al. | 106/170 |
| 3,524,796 | 8/1970 | Yul et al. | 162/158 |

*Primary Examiner*—Allan Lieberman
*Attorney, Agent, or Firm*—Fred Philpitt

[57] ABSTRACT

Ketene dimer dispersion containing cationic dispersing agent and alkyl hydroxyalkyl cellulose and use thereof to size cellulose fibres.

7 Claims, No Drawings

DISPERSION FOR SIZING CELLULOSE FIBRES AND USE THEREOF

BACKGROUND OF THE INVENTION

The present invention relates to a dispersion of ketene dimers for sizing cellulose fibres and to the use of the dispersion. In particular it relates to a dispersion containing a ketene dimer as sizing component and a cationic system of dispersing agents. The properties of the dispersing agent system are such as to make it possible to employ a very large amount of ketene dimer while maintaining the cationic properties and without causing the viscosity of the dispersion to become too high or without decreasing the storage stability of the dispersion.

It is known to use ketene dimers for sizing cellulose fibres. The ketene dimer group reacts with the hydroxy groups of the cellulose molecules resulting in an irreversible bond between the cellulose molecule and the organic, hydrophobic hydrocarbon groups in the ketene dimer molecule. When adding ketene dimers to an aqueous suspension of cellulose fibres, as so called beater additives, the ketene dimers are dispersed in the water by means of dispersing agents.

Moreover, it is known that the yield of the reaction between the ketene dimers and the cellulose fibres increases when the aqueous dispersions of the ketene dimers contain a cationic dispersing agent.

It is believed that the yield of the reaction is improved when using cationic dispersions due to increased affinity of the ketene dimer particles to the slightly negatively charged cellulose fibres.

A serious disadvantage of previously described cationic ketene dimer dispersions is that the amount of ketene dimer in the dispersion must be kept relatively low, usually about 3–8 per cent by weight. This is due partly in order to obtain an optimal cationic activity in relation to the amount of ketene dimer and partly in order not to adversely effect the viscosity to a significant extent along with the manageability and the stability of the dispersions. This, in turn, results in high transport costs of the dispersions from the manufacturer to the consumer and in the necessity of employing relatively large storage equipment.

Experiments to increase the ketene dimer content by introducing additional ketene dimer into a cationic dispersion result, of course, in dispersions having a higher solids content of ketene dimer but alter the cationic activity in the system so that the sizing effect of the dispersion, when being applied to cellulose fibres, was decreased considerably. Increasing the solids content by simultaneously increasing the amount of the ketene dimer and the cationic emulsifier results in an increase in the viscosity of the dispersion to such an extent that the dispersion becomes less manageable. Moreover, at higher concentrations, most of the cationic dispersing agents have a tendency to gelatinize the dispersion at storage.

According to the present invention it has been found that stable dispersions of ketene dimer having a solids content of up to 30 per cent by weight can be obtained, which when diluted and applied onto the cellulose fibres give an improved yield at the sizing reaction compared to most of the previously known dispersions having a lower dry content of ketene dimer.

The dispersing system according to the invention enables the preparation of ketene dimer dispersions having a high solids content without causing the viscosity of the dispersion to become so high that the manageability of the dispersion will decrease. Furthermore these dispersions are, dispite their high solids content, very stable. Storage of the dispersions for 6 months at room temperature does not affect their viscosity.

Another advantage of the dispersions of the present invention is that the amount of dispersing agent based upon the ketene dimer can be kept very low, usually as low as about 4–5 per cent by weight based on the ketene dimer. On the other hand, when using only cationic starch as dispersing agent, it should be present in an amount of at least 30 percent by weight based on ketene dimer, in order to obtain satisfactory dispersions exhibiting good sizing effect. Due to the special dispersing agent system, the compositions according to the present invention do not seem to be sensitive to the oxidizing residual chlorine, such as chlorate ions in the cellulose pulp, which is usually present when the cellulose pulp is bleached with chlorine compounds prior to the paper making.

BRIEF DESCRIPTION OF INVENTION

The present invention is concerned with a dispersion for the sizing of cellulose fibres which comprises:

A. ketene dimer,
B. water,
C. cationic dispersing agent, and
D. water-soluble or water-dispersible alkylhydroxy alkyl cellulose as additional dispersing agent.

The present invention is also concerned with the sizing of cellulose fibres by applying the above dispersion to cellulose fibres.

DESCRIPTION OF PREFERRED EMBODIMENTS

The alkyl hydroxyalkyl cellulose included in the dispersing agent system preferably comprises a water-soluble or water-dispersible cellulose having a Brookfield-viscosity within the range of from 20–12,000 cp in a 2 per cent water solution at a temperature of 20° C. Examples of some suitable types of said cellulose are those wherein the alkyl group is a alkyl group containing 1–4 carbon atoms, preferably methyl or ethyl and wherein the alkylhydroxy group is a hydroxy alkyl group containing 1–4 carbon atoms ethylhydroxy or propylhydroxy group. The carbon chain in the hydroxyalkyl group can also be interrupted by one or more ogygen atoms. Of course mixtures of the said cellulose ethers can be employed when desired.

The amount of alkyl hydroxyalkyl cellulose in the dispersions according to the invention should be within the range of from about 0.5 to about 10 per cent by weight and preferably about 0.8 to about 8 per cent by weight based on the weight of the ketene dimer.

The cationic dispersing agent employed can be any of the known water-soluble or water-dispersible cationic polymers. These polymers have been described previously as retention agents, wet strength agents or dry strength agents in paper making. Examples of the preferred cationic watersoluble or water-dispersible polymers include cationic starch, polyethylene imine, polyacrylamide, polyvinyl pyridine, polyamide-polyamineresin or its epichlorhydrinmodified derivative. Particularly favorable results have been obtained with cationic polyvinyl pyridine.

The amount of cationic polymer employed in the dispersions of the present invention should be within the range of about 0.5 to about 10 per cent by weight, and preferably about 1 to about 10 per cent by weight based upon the weight of the ketene dimer. Thus, the total amount of dispersing agent in the dispersions of the present invention is within the range of about 1 to about 20 per cent by weight, and preferably 1.8–18 per cent by weight based on the amount of ketene dimer. The ratio between the cellulose ether and the cationic polymer may vary within the range of from 1:20 – 20:1, and preferably 1:7 – 5:1.

The ketene dimers used in the invention are known per se and have the following general formula:

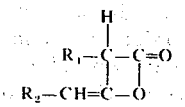

Wherein $R_1$ and $R_2$ each individually represents an organic hydrophobic hydrocarbon group having about 8–40 carbon atoms.

Examples of some suitable hydrophobic hydrocarbon groups include alkyl groups, alkenyl groups, aralkyl groups, alkaryl groups, and alkyl substituted cycloalkyl groups. Illustrative of some suitable alkyl groups for $R_1$ and $R_2$ having about 8 to about 40 carbon atoms are decyl, undecyl, dodecyl, tridecyl, tetradecyl, pentadecyl, hexadecyl, heptadecyl, octadecyl, tetracosyl, and pentacosyl groups.

The preferred alkyl groups contain from about 12 to about 30 carbon atoms. Some examples of suitable alkenyl groups containing about 8 and 40 carbon atoms include decenyl, tridecenyl, heptadecenyl, octadecenyl, eicosenyl, and tricosenyl groups.

Some suitable aralkyl, alkaryl and alkyl substituted cycloalkyl groups having at least about 8 carbon atoms include 4-tert.butylphenyl, octylphenyl, nonylphenyl, dodecylphenyl, tridecylphenyl, pentadecylphenyl, octadecylphenyl, heneicosylphenyl, nonylcyclopropyl, dodecylcyclobutyl, tridecylcyclopentyl, tetradecylcyclohexyl, pentadecylcycloheptyl and octadecyl cyclohexyl groups.

It is understood that the alkyl, alkenyl, alkaryl, aralkyl and alkylcycloalkyl groups can contain non-interfering, inert substituents as is known to persons skilled in the art. Some examples of inert substituents include ether, carboalkoxy, alkyloxy, aryloxy, arylalkyloxy, keto (carbonyl)-tert.amide groups and the like. Some radicals which preferably sould not be, to any large degree, in the hydrophobic groups $R_1$ and $R_2$ include hydroxyl groups, amide groups containing amide hydrogen primary and secondary amino groups, unstable halogens and carboxylic groups and other acidic groups. Of course, persons skilled in the art can readily determine which substituents can be employed if it is desired to avoid undesirable side reactions.

Each $R_1$ and $R_2$ individually is preferably an alkyl group containing 8 to 30 carbon atoms. Moreover, mixtures of ketene dimers can be used when desired.

The ketene dimers can be prepared by previously known methods. For instance, the ketene dimers can be obtained by reacting thionyl chloride and carboxylic acid containing the desired hydrophobic hydrocarbon group to produce the corresponding acid chloride, and then dimerizing the acid chloride by hydrogen chloride splitting to produce the desired ketene dimer.

When preparing dispersions according to the present invention, the components are mixed with water and the mixture is then exposed to vigorous shearing. In order to facilitate mixing, the aqueous phase containing cellulose ethers and cationic polymers is warmed to a temperature of about 50°–80° C, and then molten ketene dimer is added. It is important that the temperature is not kept too high since this could cause hydrolysis of the ketene dimer. The upper limit for the warming is determined by the type of ketene dimer used. The emulsion obtained after mixing and shearing is then rapidly cooled to form a stable dispersion.

The dispersions thus obtained can then immediately or after storing either be added to a suspension of cellulose fibres in water or can be used for surface coating of paper, paper board or other material containing cellulose fibres. When the dispersions are added to a suspension of fibres in water, the dispersions are first diluted to a solids content of about 3 percent by weight or less before being added to the stock suspension.

After addition of the dispersion to the stock, the pulp can be formed to sheets and dried in known ways. After the sheeting the paper can be cured by warming for a short time at a temperature of about 100° C or the paper can be cured at room temperature by merely standing for a sufficient amount of time.

The dispersing agent system employed according to the present invention makes it possible to prepare stable dispersions having a high solids content of ketene dimer without decreasing the effect of the ketene dimer as a sizing agent when diluting the dispersions and adding them to a suspension of cellulose fibres in water. According to the invention it is possible to prepare dispersions having a solids content of ketene dimer up to about 30 per cent by weight without adversely affecting the viscosity properties of the dispersions to any significant extent or its storage stability when using them as a sizing agent. The best results in this respect will be achieved by using dispersions having a solids content within the range of about 10 to about 25 per cent by weight of ketene dimer, and preferably about 15 to about 20 per cent by weight.

The following non-limiting examples are provided to illustrate the present invention in greater detail. In the examples, all parts and per cents are by weight unless the contrary is stated.

EXAMPLE 1 A–E

In the following example dispersions were prepared containing ethyl hydroxyethyl cellulose (Modocol E 200 sold by Mo och Demsjo, Sweden) as dispersing agent and the various water-soluble cationic polymers as shown in Table I.

The cellulose ether and the cationic polymers respectively were dissolved in water. The aqueous solution was adjusted to a pH of 4.0 and warmed to a temperature of 60° C. To 82 parts of each of these aqueous compositions were introduced under vigorous agitation in a Turrax agitator for 3 minutes, 18 parts of molten ketene dimer. The ketene dimer was obtained from technica grade stearic acid. The warm emulsions were then homogenized in a shearing homogeniser at a pressure of 190 kg/cm$^2$, and were cooled to room temperature while passing through a plate cooler. The resulting dispersions were thereafter stored for 1 week in a heat oven at a temperature at 40° C for evaluation of their storage stability. The results are shown in Table I. As can be seen from this table, the dispersions have a very good storage stability in spite of the disadvantageous storage conditions.

To 10 g of bleached magnephite pulp beaten to about 30° SR diluted to a solids content of 0.2 per cent containing 20 per cent whiting, based on the dry fibres, were added 1 ml of the above dispersions. The dispersions were diluted to a ketene dimer content of 1 per cent. Also 2 ml of a 0.1 per cent water solution of cationic acrylamide polymer (as retention agent for whiting and fines) are added. Sheeting was carried out in a laboratory sheet machine, the sheets were pressed, dried for 1 hour at 100° C and conditioned. A commercially available ketene dimer dispersion having a solids content of 6 percent ketene dimer and containing 50 percent cationic starch based on the ketene dimer as dispersing agent was used as reference (ref. 1 in the table).

As is shown in Table I the dispersions according to the present invention show about the same sizing effect as ketene dimer dispersion having a low dry content. This proves that a good cationic activity is obtained despite the high ketene dimer content. Unsized paper of this quality has a Cobb-number exceeding 130 g/m².

EXAMPLE 2 A–B

Different dispersions of the same ketene dimer were prepared in the same manner as described in Example 1 with the exception that the cationic dispersing agent polyvinyl pyridine and its amount were kept constant and that methyl hydroxypropyl or ethyl hydroxyethyl cellulose were used as additional dispersing agent. As a comparison to this cellulose ether, a similar compound, hydroxyethyl cellulose (ref. 2 in the table), was used. The different dispersions were stored in the same way as described in Example 1 and the results are shown in Table I.

As can be seen from the table it is essential for the storage stability of the dispersions that alkyl hydroxyalkyl cellulose is present.

The storage-stable above mentioned dispersions were used for sizing of bleached magnephite pulp in the same manner as described in Example 1. Table I demonstrates that the sizing effect obtained in general is the same as the effect obtained with ketene dimer dispersions having low solids content.

EXAMPLE 3

In a laboratory paper making machine having a capacity of 50 kg paper per hour at a gram weight of 65 g/m², two sizing systems were compared. One was a composition according to the invention and the other one was a commercially available sizing system.

The sizing system I (according to the present invention) was a 18 percent ketene dimer (prepared from technical grade stearicacid) dispersion containing 1.4 percent ethyl hydroxyethyl cellulose and 4.2 percent polyvinyl pyridine as dispersing agent based on the ketene dimer. A cationic polyacrylamide as retention agent for fines and filler was also added to the stock. The 18 percent dispersion was diluted with water prior to the addition to the stock and the final concentration of ketene dimer in the stock was 0.08 percent based on the solids weight of the fibres. The amount of retention agent was 0.03 percent based on the solids content of the fibres.

The sizing system II (a commercially available product) was a 6 percent ketene dimer dispersion containing, as a dispersing agent, 50 percent cationic starch based on the ketene dimer. As retention agent for fines and fillers was used an epichlorhydrin modifier cationic polyamide-polyamine resin. The 6 per cent dispersion was diluted with water prior to addition to the stock. The final concentration of ketene dimer in the stock was 0.1 percent based on the dry weight of the fibres, and the amount of retention agent was 0.07 percent based upon the dry weight of the fibres.

The pulp was bleached birch sulfate. The sizing tests were carried out both at normal conditions (A = pH was adjusted to 7.5 by addition of sodium bicarbonate) and the following conditions:

1. in the form of a low pH (B),
2. in the presence of chlorate ions (C = addition of about 1% sodium chlorate) in order to simulate residual chlorine from the bleaching step of the pulp,
3. by adding 0.3% of alum (D). In all cases the tests were carried out both with and without a filler. The sizing effect was determined after natural aging of the paper for 14 days at a temperature of 23° C and a relative humidity of 50 percent.

The results are shown in the following table.

TABLE I

| Ex. | Amount dispersing agent counted on the amount of ketene dimer (% by weight) | | | | | | | | Amount ketene dimer in % by weight counted on the dispersion | Viscosity according to Fordcup sek/20°C | Separation after one week at 40°C (%) | Sizing effect[1] $Cobb_{60}$ g/m² |
|---|---|---|---|---|---|---|---|---|---|---|---|---|
| | poly ethylene imine | cationic starch | polyvinyl pyridine | polyacrylamide | epichlorhydrin modified polyamide-polyamine | ethyl hydroxyethyl cellulose | methyl hydroxypropyl cellulose | hydroxyetyl cellulose | | | | |
| | 4.2 | | | | | 2.5 | | | 18 | 16 | 2 | 30 |
| | | 4.2 | | | | 2.5 | | | 18 | 29 | 7 | 50 |
| | | | 4.2 | | | 2.5 | | | 18 | 23 | 4 | 22 |
| | | | | 2.2 | | 2.5 | | | 18 | 17 | 8 | 27 |
| | | | | | 20.0 | 2.5 | | | 18 | 16 | 2 | 23 |
| | | | 4.2 | | | | 3.3 | | 18 | 18 | 4 | 23 |
| | | | 4.2 | | | 1.7 | | | 18 | 23 | 9 | 22 |
| 1 | | 50 | | | | | | | 6 | 12 | 0 | 22.5 |
| 2 | | | 4.2 | | | | | 5 | 18 | 12 | gelatinization | — |

[1] according to SCAN-P 12 64 Cobb number for unsized paper 130 g/m²

TABLE II

| Test | pH | Additive | Sizing effect $Cobb_{60}$ g/m² | |
|---|---|---|---|---|
| | | | Sizing system I | Sizing system II |
| A | 7.5 | without filler | 27.8 | 46.2 |
| A | 7.5 | whiting | 29.5 | 31.6 |
| B | 6.8 | without filler | 27.1 | 32.3 |
| B | 7.1 | whiting | 27.5 | 29.7 |
| C | 7.5 | without filler | 29.6 | 64.0 |
| C | 7.5 | whiting | 29.5 | 31.4 |
| D | 7.5 | without filler | 28.0 | 28.5 |
| D | 7.5 | whiting | 29.3 | 28.6 |

As can be seen from the above table, a very uniform sizing effect is achieved when using the dispersions according to the present invention. Moreover, the present dispersions show improved sizing effect in comparison to the previously known sizing system even though 20 percent less ketene dimer was used in the dispersions of the present invention.

What is claimed is:

1. A cationic dispersion for the sizing of cellulose fibers having a total solids content of up to 30 percent by weight which contains a. ketene dimer, having the general formula

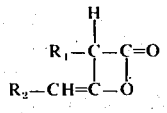

wherein $R_1$ and $R_2$ each individually represents an organic hydrophobic hydrocarbon group having about 8 – 40 carbon atoms, b. water, c. a dispersing agent selected from the group consisting of a water-soluble or water-dispersible cationic polymer, the amount of the dispersing agent being within the range of about 0.5 to 10 percent by weight based upon the weight of the ketene dimer; and d. a water-soluble or water-dispersible alkyl hydroxyalkyl cellulose, wherein the alkyl groups contain 1 – 4 carbon atoms, in an amount within the range of about 0.5 to 10 percent by weight based upon the weight of the ketene dimer, e. the ratio of cellulose ether to cationic polymer being within the range of 1:20 – 20:1, f. said alkyl hydroxyalkyl cellulose having a Brookfield viscosity within the range of from 20 – 12,000 cp in a 2 percent water solution at a temperature of 20°C.

2. The dispersion of claim 1 wherein said cationic dispersing agent is polyvinyl pyridine.

3. The dispersion of claim 1 wherein the solids content of ketene dimer is within the range of about 10 to about 25 per cent by weight.

4. The dispersion of claim 1 wherein the solids content of ketene dimer is within the range of about 15 to about 20 per cent by weight.

5. The dispersion of claim 1 wherein said alkylhydroxyalkyl cellulose is selected from the group of ethyl hydroxyethyl cellulose, methyl hydroxypropyl cellulose, and mixtures thereof.

6. The dispersion of claim 1 wherein said cationic dispersing agent is selected from the group of polyethylene imine, cationic starch, polyvinyl pyridine, polyacrylamide, polyalkylene polyamide, epichlorohydrin derivative of polyalkylene polyamide, and mixtures thereof.

7. The process of sizing cellulose fibres which comprises applying the composition of claim 1 to said cellulose fibres.

* * * * *